US006898920B2

(12) United States Patent
Höss

(10) Patent No.: US 6,898,920 B2
(45) Date of Patent: May 31, 2005

(54) DEVICE FOR ARRESTING A BOTTLE AGAINST AN APPLIED TORQUE

(75) Inventor: Hans Höss, Lautertal (DE)

(73) Assignee: Tetra Laval Holdings & Finances, S.A., Pully (CH)

( * ) Notice: Subject to any disclaimer, the term of this patent is extended or adjusted under 35 U.S.C. 154(b) by 64 days.

(21) Appl. No.: 10/344,617

(22) PCT Filed: Jul. 25, 2001

(86) PCT No.: PCT/EP01/08588

§ 371 (c)(1),
(2), (4) Date: Feb. 12, 2003

(87) PCT Pub. No.: WO02/16251

PCT Pub. Date: Feb. 28, 2002

(65) Prior Publication Data

US 2003/0173258 A1 Sep. 18, 2003

(30) Foreign Application Priority Data

Aug. 18, 2000 (DE) ..... 100 40 374.3

(51) Int. Cl.[7] ..... B65B 7/28
(52) U.S. Cl. ..... 53/300; 53/317; 269/268
(58) Field of Search ..... 269/268, 287; 53/300, 317, 331.5, 490

(56) References Cited

U.S. PATENT DOCUMENTS 2,987,313 A * 6/1961 Bjering ..... 53/300
4,114,347 A * 9/1978 Morris et al. ..... 53/300
4,624,098 A * 11/1986 Trendel ..... 53/314
4,939,890 A * 7/1990 Peronek et al. ..... 53/490
5,373,934 A * 12/1994 Jackson et al. ..... 198/803.8
5,408,801 A * 4/1995 Molinaro ..... 53/331.5
5,778,633 A * 7/1998 Sweeny ..... 53/300
6,334,289 B1 * 1/2002 Buchel ..... 53/300

* cited by examiner

*Primary Examiner*—John Sipos
(74) *Attorney, Agent, or Firm*—Paul & Paul

(57) ABSTRACT

The device for holding in an axial direction a pouring neck of a bottle having a radially projecting neck ring and for arresting the pouring neck against a torque applied to the pouring neck in one of two rotary directions upon rotation about the axis of the pouring neck has a carrier (1) which is open at one side and which partially embraces the pouring neck and which has a U-shaped opening (2) with an arcuate bottom (3) whose central axis is perpendicular to the carrier (1), and also has a projecting engagement portion (9) for arresting against rotary movements. To improve such a device so that the pouring nick which is to be arrested can be more easily introduced into the carrier and removed therefrom again, even when a plurality of pouring necks is being simultaneously loaded and unloaded, wherein the device is simple to produce without involving high cost and preferably involves less wear, the invention provides that the projecting arresting engagement portion(9) is arranged in the direction of the central axis at the level of the arcuate bottom (3) of the carrier (1) on the extended arc**(3*a*) of the bottom (3) displaced in relation thereto in the region of the open side of the bottom (3) and a counterpart support (12) is provided on the other side approximately on the extended arc (3*a*) in opposite relationship to the engagement portion (9)**.

8 Claims, 4 Drawing Sheets

Figure 1:
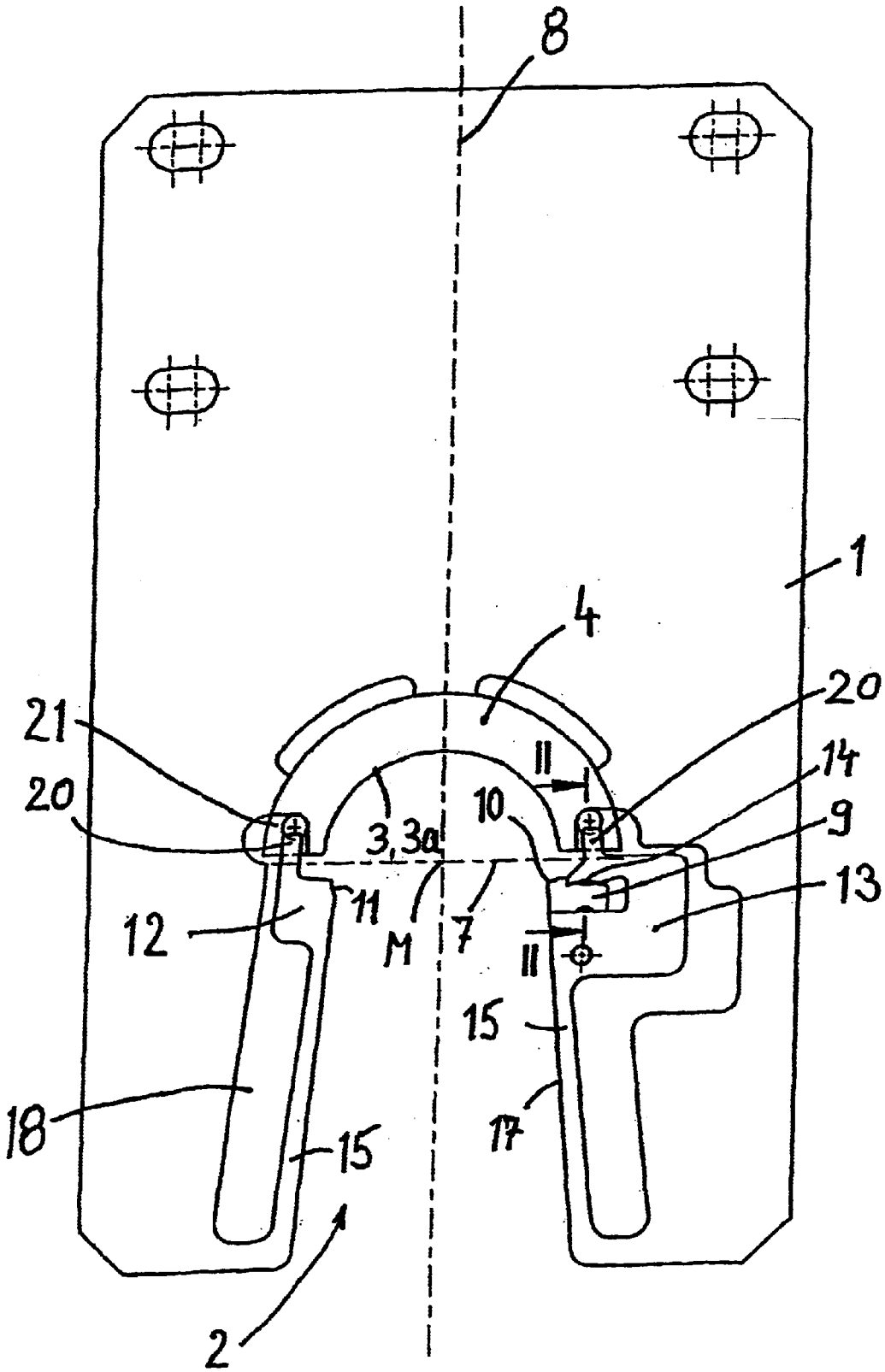

Fig. 7
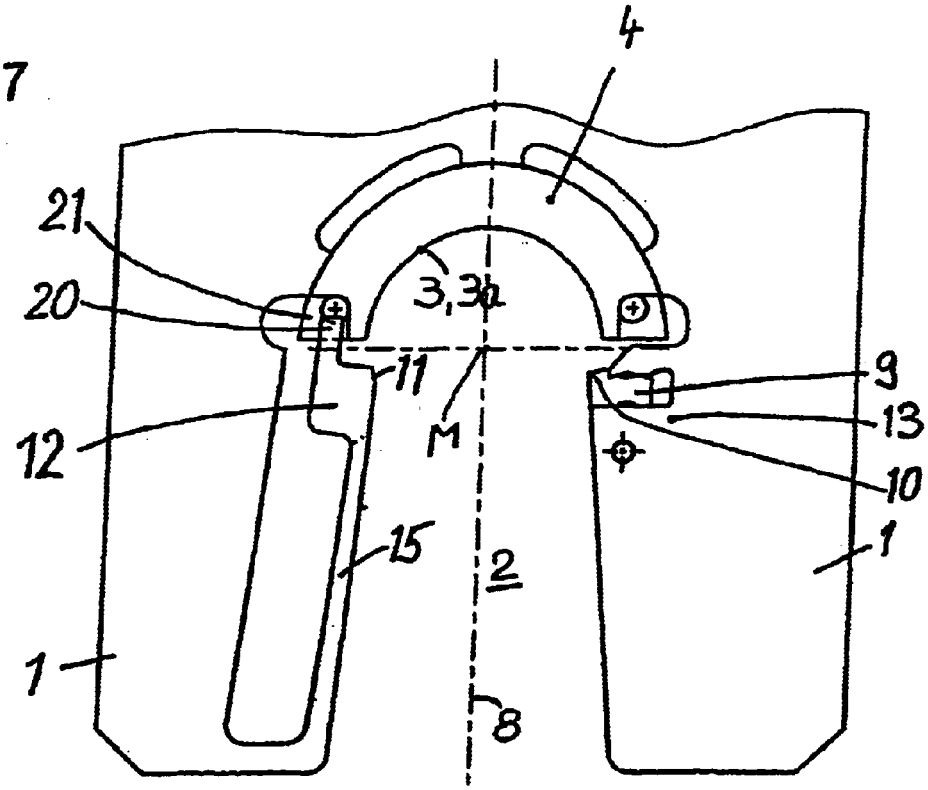
Fig. 8
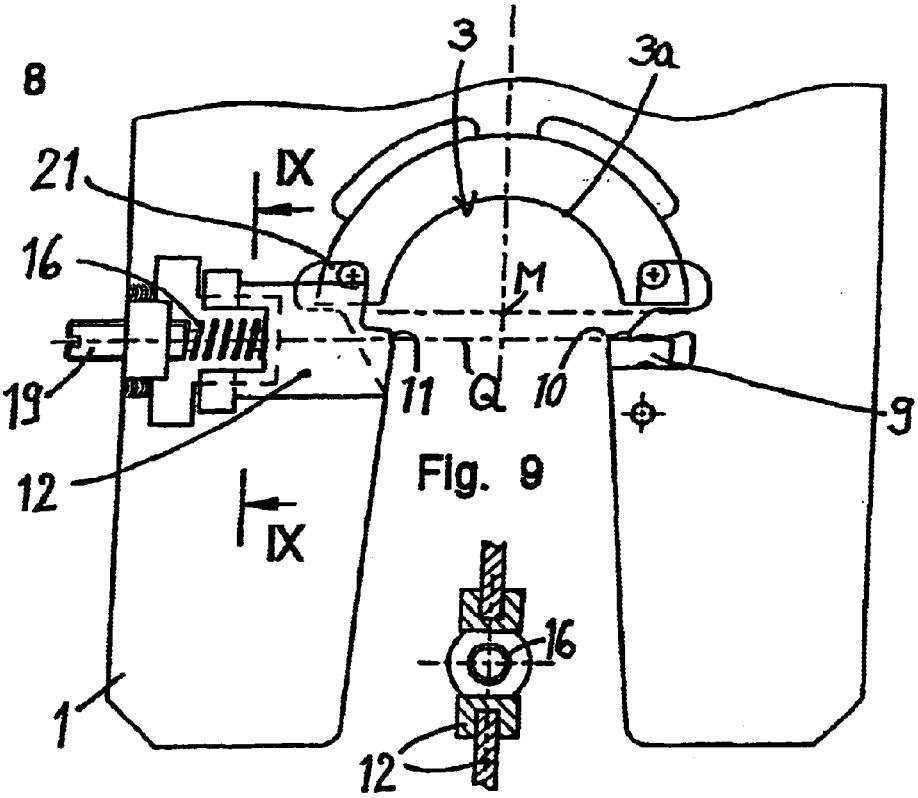
Fig. 9

DEVICE FOR ARRESTING A BOTTLE AGAINST AN APPLIED TORQUE

The invention concerns a device for holding in the axial direction a round body having at least one radial projection and for arresting same against a torque applied to the body in one of two rotary directions upon rotation about the axis of the body, comprising a carrier which is open at one side and which partially embraces the body and which has a U-shaped opening with an arcuate bottom whose central axis is perpendicular to the carrier, and a projecting engagement portion for arresting against rotary movements.

There are already devices for holding and transporting plastic bottles, in which the bottle neck is produced in one piece with the main body from plastic material. The bottle or pouring neck of known containers externally carries a screwthread, on to which a suitable closure cap can be screwed. Extending radially from the surface of the pouring neck is a neck ring which is frequently used for holding the plastic bottle. In that connection the neck ring can rest on rails and the bottle can be advanced by gripping devices, conveyor belts and so forth.

After such plastic bottles are filled with product, screw caps are usually automatically screwed on to the pouring neck which is provided with a male screwthread. When the content of the bottle is liquid, such a high level of torque has to be applied in the last screwing-on phase that sealing integrity in regard to the liquid is achieved with the screw cap. The pouring neck or the bottle then has to be suitably arrested to prevent rotary movements.

To provide that arresting action there is already a device for holding plastic bottles fast at the main body by means of holding jaws comprising two angle portions which can move relative to each other in such a way that there is an opening movement and conversely also a closing movement can be achieved, with a corresponding pressure applied to the surface of the main body. In the known device, a plurality of holding jaws which in themselves are movable and controllable have to be applied, and not only the structure thereof but also the control and operation thereof involve a considerable amount of expenditure and wear.

Another known arresting device similar to the device set forth in the opening part of this specification for holding and arresting pouring necks of plastic bottles admittedly also has a U-shaped opening with an arcuate bottom, but points, prongs or pins which are arranged at a spacing of 90° relative to each other are so arranged on the carrier surface that they project in the direction of the central axis perpendicularly from the surface of the carrier. The neck ring of a bottle pouring neck can be pressed from above on to those spike-like prongs so that they dig into the neck ring from below and arrest the neck ring to resist torques. There is the disadvantage here however that this can only be achieved with the application of a high axial pressure because otherwise the neck ring moves over the pointed projections, even if traces of scratching are produced. It has further been found that application of such prongs or pins is difficult during the production process. In addition the pins suffer from severe wear in the course of operation. The manufacturing cost is further increased if those pins or prongs are made from hard metal. Even then however a high rate of wear is to be found.

Particular difficulty is involved however in introducing bottles provided with screw caps while the removal thereof is even more difficult, because the neck ring of the respective pouring neck first has to be released in the transverse direction from the tips of the prongs, which so-to-speak have dug in. It is precisely the holding edges of the pins which have pressed into the neck ring so that the bottle would have to be lifted in the axial direction. Under those conditions, removal of a plastic bottle with a screw cap which is automatically firmly screwed on can be ensured only with difficulty and in a complicated procedure.

Therefore the object of the present invention is to be improve a device of the kind set forth in the opening part of this specification for holding and arresting round bodies, in such a way that the body to be arrested can be more easily introduced into the carrier and removed therefrom again, even if a plurality of bodies is simultaneously loaded and unloaded, in which respect the device is to be simple to manufacture without involving a high level of cost and there is preferably less wear.

In accordance with the invention that object is attained in that the projecting retaining engagement portion is arranged in the direction of the central axis at the level of the arcuate bottom of the carrier on the extended arc of the bottom in displaced relationship with respect thereto in the region of the open side of the bottom and a counterpart support is provided on the other side on the extended arc opposite the engagement portion.

Holding a round body in the direction of its axis is implemented in a comparatively simple manner by virtue of the fact that the round body has a radial projection. For example in the case of the plastic bottle the pouring neck thereof has a neck ring. In contrast arresting it to prevent movement in the direction of rotation (upon rotation of the body about its axis) is more difficult. In accordance with the invention the arresting action is effected in a particularly far-reaching and comprehensive manner because it is only aimed at one of two directions of rotation.

The 'round body' which is generally cylindrical on its outside surface can be introduced into the carrier which is open at one side, rotating in one direction, and with hooking engagement or claw-like engagement, is arrested to prevent further rotary movement in that direction when the round body has reached the arcuate bottom of the U-shaped opening. In the opposite direction of rotation in contrast the arresting action can be released just by rotation in the opposite direction and then the round body can be rotated out, if there is also just a small transverse displacement movement.

In that way it is possible to arrest plastic tubes and cut screwthreads in the outside surfaces thereof. It is also possible for coils to be introduced into the device according to the invention and arrested there, in which respect it is possible in particular to produce coils by arresting the winding core (for example for electrical coils) and winding on wires. This therefore affords the most widely varying possible uses for the device according to the invention having the described features.

What is common to all devices is that the projecting arresting engagement portion does not project in the direction of the central axis of the arc, that is to say perpendicularly to the carrier which at least in part is to be considered as being flat, as in the case of the known device; but it projects radially in a direction towards the central region of the arc. The function of such a radially projecting engagement portion then presupposes that the engagement portion is substantially in the region of the carrier and does not protrude either perpendicularly upwardly or downwardly far out of same. If the arc of that arcuate bottom of the carrier is considered, then that arc has a central axis which is perpendicular to the carrier. In the region of the carrier, that central axis intersects the plane of the carrier. In accordance with the invention the arresting engagement portion is at the level of that intersection region. It is therefore arranged at the level of the carrier and therefore does not project far either in relation to one side of the carrier or the other side.

In that way the arresting engagement portion can engage into a suitable peripheral region of the round body, from the outside, and arrest the round body to prevent rotation thereof.

In a particularly effective manner the arresting engagement portion engages into the round outer wall of the body for arresting thereof if the engagement portion is arranged on the extended arc, but somewhat displaced in relation to the arc.

As is known, an 'arc' is a part of a curved line, a curve; more specifically a circle. For reasons relating to production engineering, the bottom of the carrier, with which we are concerned here, will preferably involve a circular arc. The arc involves the bottom of the U-shaped opening so that accordingly at the bottom the edge of the carrier only follows part of a circle. If the specific circular arc is extended, that affords a notional circle, in the region of which the arresting engagement portion is to be envisaged as being arranged.

That notional supplemental portion of the circular arc, that is to say what is referred to here as the extended arc, is disposed in the region of the open side of the bottom, preferably opposite the bottom. The arresting engagement portion however is preferably arranged in the transitional region between the limbs of the U-shape and the bottom thereof.

Correspondingly, a counterpart support is arranged on the opposite side and equally in the region of the extended arc in opposite relationship to the engagement portion. The round body which has just been introduced is supported on the counterpart support and can also be moved relative thereto, displaced and rotated, while the surface of the round body is hooked and engaged on the other side, by the arresting engagement portion.

By virtue of the features according to the invention the body to be arrested can be more easily introduced into the carrier and comfortably removed from the carrier again by way of the co-operation between the engagement portion which has a claw-like action, on the one hand, and the counterpart support on the other hand. That is effected even with simultaneous movement of a plurality of bodies. The device for holding and arresting the round body is also to be produced in large numbers, with simple technical means.

It is particularly desirable in this respect if, in accordance with the invention, the counterpart support is provided with an inclined run-out surface supporting the round body and is resiliently biased in a direction approximately towards the central point, which is on the central axis, of the part-circular arc. It is admittedly possible to imagine a fixed counterpart support if preferably the holding means of the engagement portion is resilient. It can however be particularly simple for the counterpart support to be of a resiliently biased design structure and for the relative movements of the surface of the round body with respect to the counterpart support to be promoted by an inclined run-out surface. The counterpart support is then preferably biased towards the central region of the arc.

In accordance with the understanding of the invention the closed side of the U-shaped opening of the carrier is formed by the arc which is preferably a circular arc with a central point through which the central axis is passed perpendicularly to the plane of the carrier.

Alternatively or additionally however the arresting engagement portion can also be provided with a projecting edge and can be resiliently biased in a direction approximately towards the central point, which is on the central axis, of the part-circular arc. Therefore either only the counterpart support or only the arresting engagement portion can be resiliently biased, or it is possible for both, that is to say the engagement portion and also the counterpart support, to be resiliently biased.

The arresting engagement portion desirably has a projecting edge as the operative location thereof. It is particularly advantageous in that respect if the arresting engagement portion is a cutting insert which is fixed in a holder. Cutting inserts can be inexpensively obtained on the market in large numbers. If such a cutting insert is reliably fixed in a holder so that the edge of the cutting insert, so-to-speak the cutting edge, projects radially towards the center of the arcuate bottom of the carrier, the operative edge can be effectively and inexpensively produced, as the engagement portion.

A further preferred embodiment according to the invention is characterised in that the counterpart support and/or the holder for the arresting engagement portion has a spring arm which forms the side limb edge of the U-shaped opening of the carrier and is fixed at the open end of the U-shaped opening to the carrier and the carrier has undercut configurations behind the spring arm. Such an embodiment can be produced easily, for example by means of a flat plate, for example of stainless steel. Besides the U-shaped opening in the plate-shaped carrier, undercut configurations can then be formed immediately in such a way that the spring arms for the counterpart support and the holder are formed. Alternatively it is also possible to provide only one spring arm for the counterpart support or for the holder. The spring arm forms a resiliently elastic portion which can be bent from the front, that is to say from the side limb edge, rearwardly, into the undercut configuration, with the result that the spring arm thereafter moves elastically back into its original position again. The respective spring arm is thus integrally formed at the outside at the U-shaped opening on the carrier; but in another embodiment it can also be produced as an extra. The undercut configurations provide spaces into which the spring arm can be moved. Disposed on the spring arm which desirably extends over the major part of the side limb of the U-shape, on the inner side of the U-shaped opening, is the holder with the arresting engagement portion mounted thereto. Correspondingly preferably disposed on the side with the counterpart support is a region, which is thickened in comparison with the thin spring, and which has the above-mentioned inclined run-out surface.

In a further advantageous configuration of the invention the arcuate bottom of the carrier is formed by an approximately semicircular arc plate which is fixed to the carrier and the thickness of which, in the direction of the central axis, is greater than that of the carrier, and the free ends of the arc plate have recesses for supporting abutments disposed on the spring arms. If the carrier comprises a substantially flat steel plate then the arcuate bottom can be formed by a corresponding arcuate edge of the carrier. The other embodiment described herein, for forming the arcuate bottom, uses a special arc plate of a greater thickness than the thickness of the carrier itself. That arc plate is fixedly mounted in a corresponding recess in the closed region of the U-shaped opening. If the arc plate also comprises steel, then it can be mounted to the carrier for example by welding.

The purpose of the greater thickness of the arc plate in relation to the carrier is that the abutments which are disposed at the inwardly extending free ends of the spring arms are supported in the above-mentioned recesses on sliding bearings. That support action is operative in the direction of the described central axis and in operation acts in opposition to a pressure force in the direction of the central axis. That advantageously prevents the spring arms from distorting. The recesses can be viewed as milled-out openings which predetermine a plane which is parallel to that of the carrier and on which the abutments on the spring arms can slide. They slide when the spring arm is bent in opposite relationship to its spring force or moves back again respectively. The movement of the spring arm therefore takes place approximately in the direction of the plane of the carrier. Disadvantageous flexural distortion of the spring arm in a direction perpendicularly thereto is prevented by the recesses.

It is further particularly advantageous in accordance with the invention if the surfaces of the carrier are in a plane flush with respect to the surfaces of the spring arms, the holders with the abutments and the arc plate. The above-described thicker arc plate (thicker than the carrier) means that it is possible to provide a recess for forming a sliding bearing, the sliding plane of which comes into contact with the underside of the abutments at the spring arms, in which case there is then always still enough material beneath the spring arms and thus the carrier. If now in accordance with the last-mentioned features the surfaces of the carrier and the arc plate are designed to be disposed flush in one plane, the arc plate projects downwardly out of the underneath surface of the carrier. On the upwardly arranged surface it is then advantageously possible to particularly well clean all parts, for example spraying them with liquid cleaning agents and possibly also wiping them off. That flush arrangement of the surfaces in one plane also makes it easier to introduce and remove the body to be arrested because the holding portions thereof do not then collide anywhere.

Those considerations play a particular part when, in a further configuration of the invention, the round body to be arrested is the pouring neck, comprising plastic material, of a pack, and the inside diameter of the arc plate is approximately equal to the outside diameter of the pouring neck. The pouring neck has the neck ring as the radial projection.

The part of the pouring neck, which part is in the form of a cylindrical surface and which remains between the neck ring and the main body of the pack, for example a plastic bottle, is of an outside diameter which is approximately equal to and preferably somewhat smaller than the inside diameter of the arc plate. In that way it is possible for the pouring neck to be pushed into the U-shaped opening of the carrier and the entire pack, held by way of the pouring neck, can hang downwardly from the carrier. Axial holding of the pack and its pouring neck which is disposed centrally in the upper part thereof and which represents the 'round body' is effected by way of the radial projection, that is to say by way of the neck ring. Then, the projecting edge of the cutting insert engages into the above-described cylindrical part between the neck ring and the main body of the pack and obviously easily provides for effectively arresting it to prevent movement in at least one of two directions of rotation.

When using the described holding and arresting device according to the invention, it is also possible for a plurality of packs with pouring necks and a male screwthread to be fitted simultaneously with a corresponding number of screw caps, involving a considerable torque, in such a way that sealing integrity in relation to the liquid therein is afforded. Nonetheless after the caps have been screwed on the packs can be rotated out of the U-shaped opening of the respective carrier again, with the application of a small amount of force, in the opposite direction of rotation. In that removal movement, either the spring arm can be elastically pushed out of the path of movement with the engagement portion or, for the situation where the engagement portion is rigidly fixed to the carrier, the oppositely disposed counterpart support on a resilient portion, preferably on a spring arm, can be pushed out of the path of movement; or both portions are resiliently biased.

The device according to the invention ensures that the respective round body is embraced in a very good and extensive fashion. The outer surface, which is in the form of part of a cylindrical surface, of the round body can be inserted precisely into the bottom of the U-shaped opening in the carrier, possibly inserted in part with a slight rotary movement. Holding the round body is particularly desirable especially when processing plastic bottles because then the processing position is precisely observed.

If the carrier in the case of a pack-processing machine represents a very large metal plate with numerous U-shaped recesses, then a hygiene space can be delimited by the carrier so that the respective pouring neck is in the hygiene space and can be made and kept substantially germ-free. After the processed products have left such a machine can be cleaned in a particularly effective and thorough fashion, especially in the region of the hygiene space. As is known smooth surfaces can be better sprayed off and germs can be avoided or reduced there, due to the absence of dead spaces.

Admittedly a particular arc must be used as the bottom of the U-shaped opening, for each outside diameter of a corresponding round body. It is precisely in the case of plastic bottles however that the pouring necks are standardised or are subject to an industrial standard so that generally a plurality of products can be handled with one and the same tool.

Figure 3:
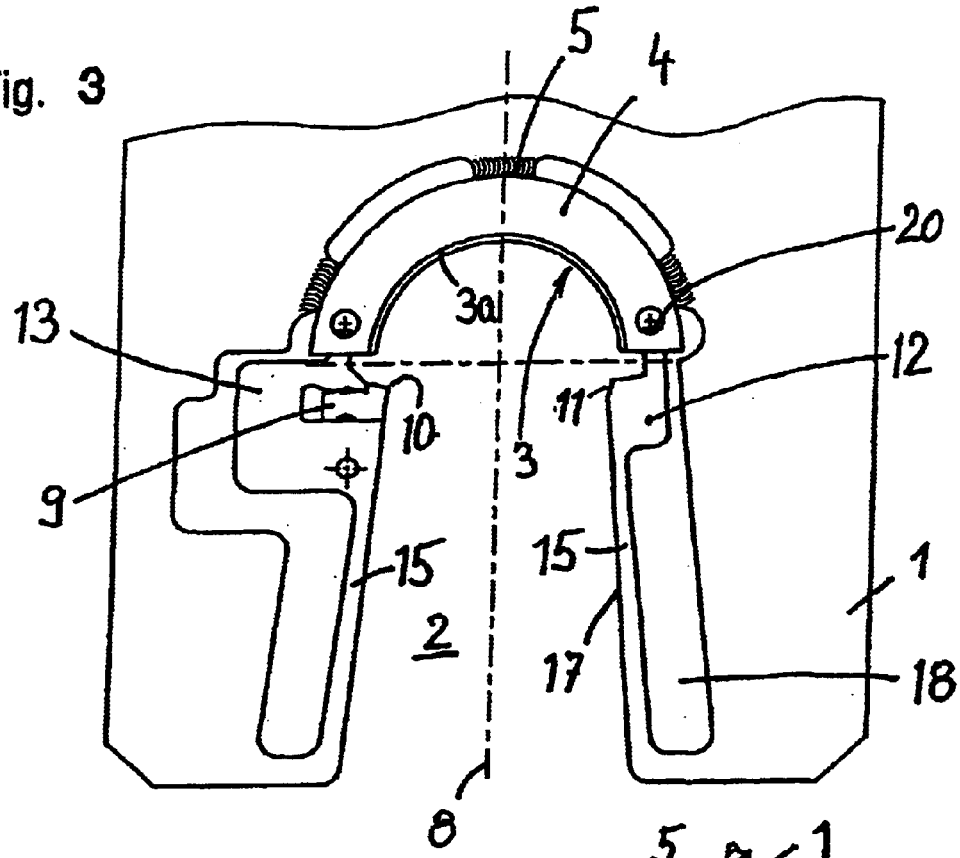
Figure 2:
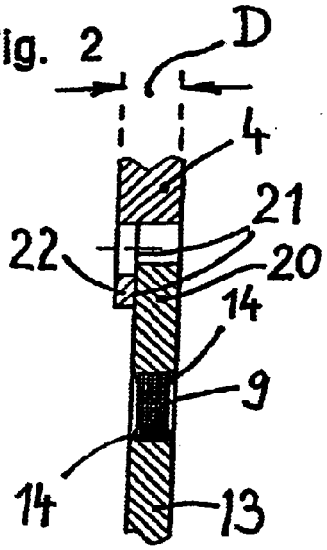
Figure 5:
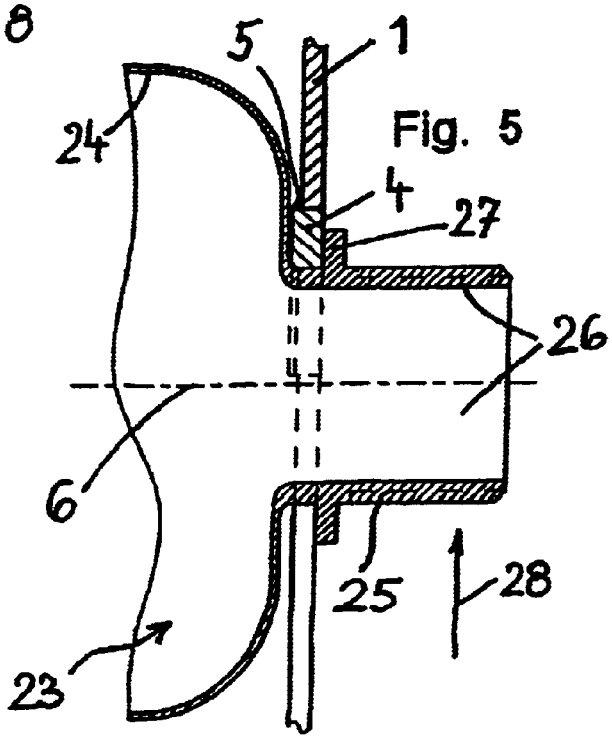
Figure 4:
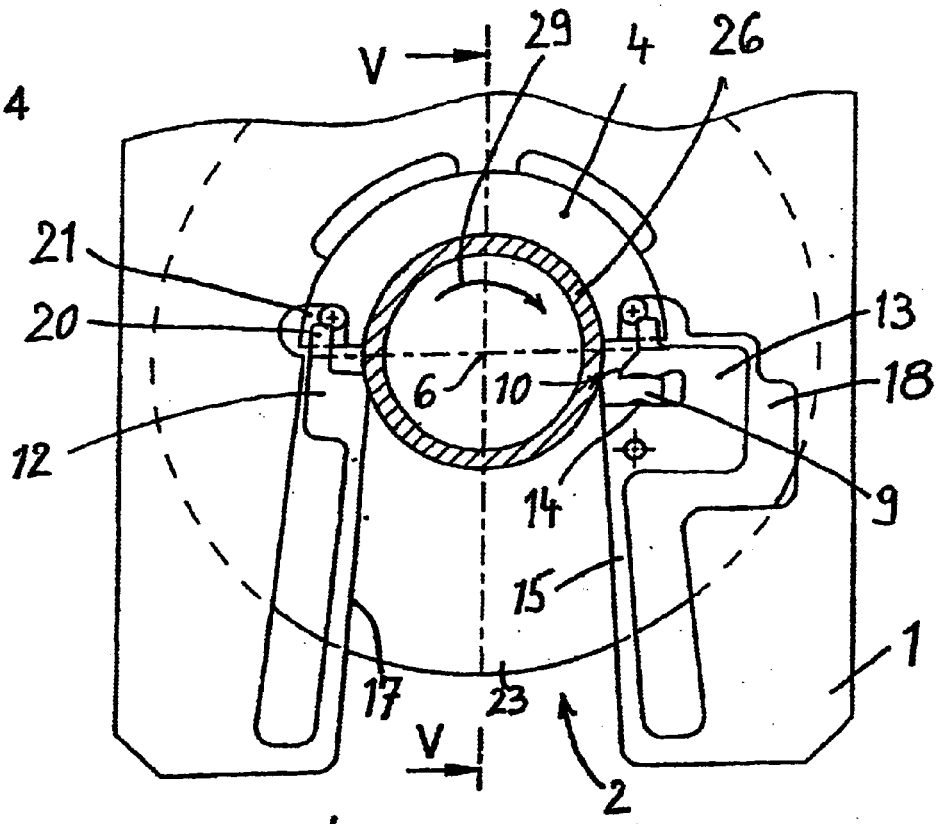
Figure 6:
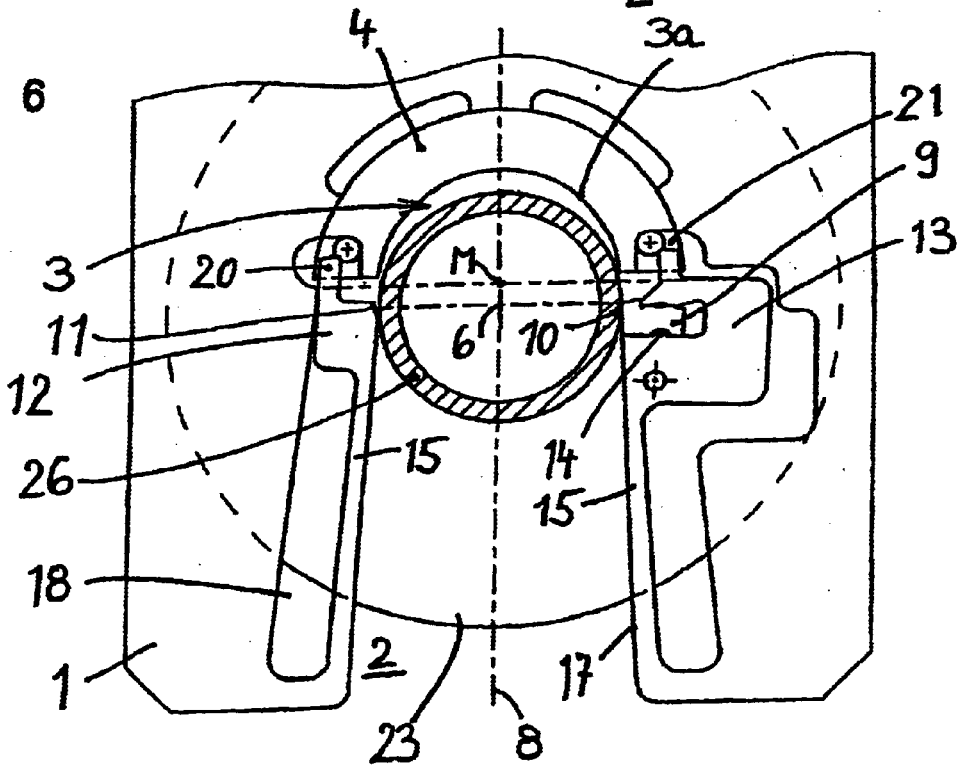

Further advantages, features and possible uses of the present invention will be apparent from the description hereinafter of preferred embodiments in conjunction with the accompanying drawings in which:

FIG. 1 shows a plan view of a first embodiment with a carrier in the form of a flat steel plate which downwardly has a U-shaped opening, with an inwardly upwardly arranged arcuate bottom, wherein both side limb edges are formed by spring arms and both the engagement portion and also the counterpart support are mounted to a spring arm, FIG. 2 shows a broken-away partial section taken along line II—II in FIG. 1, FIG. 3 shows a view of the plate-shaped carrier in FIG. 1 from below in the opposite direction to the direction of view in FIG. 1, FIG. 4 shows the embodiment of FIG. 1 with the inserted pouring neck of a plastic bottle, FIG. 5 shows a partly broken-away cross-sectional view taken along line V—V in FIG. 4, FIG. 6 shows a similar view to FIG. 4 but in which the round body in the form of the pouring neck of the plastic bottle is just leaving the bottom of the U-shaped opening in the carrier, FIG. 7 shows another embodiment of the device with a rigidly mounted engagement portion and a resiliently biased counterpart support, FIG. 8 shows a further different embodiment with a rigidly mounted engagement portion and a resiliently biased slider with counterpart support, the turning-out moment of the slider being adjustable, and FIG. 9 shows a cross-sectional view taken along line IX—IX in FIG. 8.

FIG. 1 shows a plan view of a carrier 1 in the form of a flat plate of stainless steel, of a thickness of 3 mm. A U-shaped opening 2 extends into the carrier from the lower edge which is shown here in the Figures. On its rear or inner side the opening 2 is closed by an arcuate bottom 3. That predetermines an arc which is identified here by reference 3*a*.

In the embodiments illustrated here the arcuate bottom 3 of the carrier is formed by an arc plate 4 which is almost semicircular and which is welded to the carrier 1 along the locations shown in the form of weld beads 5. A central axis 6 which can be seen in the view illustrated in FIG. 5 can be laid perpendicularly to the plane of the paper and thus perpendicularly to the carrier 1 through the central point M which is the central point of the circle on which the arc 3*a* lies.

As viewed in the direction of that central axis 6, also disposed at the same level as the carrier 1 is the arc plate 4, in the region of the open side of the bottom 3, through which the broken diametral line 7 of the arc 3*a* also passes (perpendicularly to the longitudinal axis 8 of the carrier 1). Disposed also at that common height is a projecting arresting engagement portion 9 in the form of a cutting insert having a projecting edge 10 (cutting edge). Engagement portion 9 is displaced with respect to arc 3*a*, this being a radial offsetting of engagement portion 9 relative to the arc 3*a*. If the arc 3*a* were to be extended in a manner not shown herein, then in the region of the open side of the bottom 3, on the one side, which is considered here, of the U-shaped opening 2, it would meet the projecting edge 10 of the engagement portion 9.

If, when considering FIGS. 1, 7 and 8, that notional circular arc were to be further followed in the clockwise direction, then after going beyond the longitudinal axis 8 of the carrier 1, it would reach the 'other side' of the U-shaped opening 2 and in mirror-image relationship with the engagement portion 9, it would meet the inclined run-out surface 11 of a counterpart support 12. That location is viewed as being 'displaced' with respect to the arc 3*a*, for the arc 3*a* first has to be extended somewhat in order to arrive at that inclined run-out surface 11 of the counterpart support 12.

Disposed on the side opposite to the counterpart support 12 with respect to the longitudinal axis 8 of the carrier 1 is the engagement portion 9 in the form of the cutting insert which is braced in a holder 13 at the fixing locations 14.

In the embodiment shown in FIGS. 1 through 6 both the counterpart support 12 and also the holder 13 are fixed to the carrier by way of a straight spring arm 15, at the open end of the U-shaped opening 2. The respective spring arm is cut integrally out of the material of the carrier 1. In the embodiment shown in FIG. 7, only the counterpart support 12 is fixed to the carrier 1 by way of a spring arm 15 which is integrally connected to the counterpart support 12. In the embodiment in FIG. 8 the inclined run-out surface 11 of the counterpart support 12 is resiliently biased, by way of a structure in the form of a slider (counterpart support 12), with compression spring 16.

Both embodiments, both the spring arm 15 and also the counterpart support 12 in the form of a slider, provide for resilient biasing of the counterpart support 12 or the holder 13 respectively with the engagement portion 9 approximately in a direction towards the center point M of the part-circular arc 3*a*.

In the embodiment with the spring arms 15 they extend parallel to the limbs of the U-shape of the U-shaped opening 2. The respective spring arm 15 forms in practice the side limb edge 17 of the U-shaped opening of the carrier 1. As viewed from the longitudinal axis 8 of the carrier 1 beyond that respective side limb edge 17 towards the side, it will be seen that there are undercut configurations 18 in the carrier 1. They make it possible to produce the thin, elastically resilient spring arm 15 and they also permit a resilient tilting movement into the undercut configuration 18, about the respective lower fixing point.

In the embodiment shown in FIG. 8 a slider is reciprocatable in a straight line along the transverse line Q shown in broken line, in order thereby to increase or reduce the spacing between the projecting edge 10 of the cutting insert and the inclined run-out surface 11 of the counterpart support. From the outside (from the left in FIG. 1) the slider of the counterpart support 12 is in the form of a captive sliding block and accommodates the compression spring 16, the pressure of which can be adjusted, that is to say increased or reduced, by means of the adjusting screw 19. This means that it is possible to adjust the turning-out torque of the round body (which is still to be described) out of the U-shaped opening 2 of the carrier 1 and into same.

FIG. 9 is a view taken along line IX—IX in FIG. 8, the counterpart support 12 here being clearly provided with a captive sliding block which embraces the spring 16.

The embodiments of FIGS. 7 and 8 do not need to be particularly described in relation to the engagement portion 9. There the holder 13 is not fixed to a spring arm but is directly rigidly fixed to the carrier 1 or is formed in one piece therewith.

In all embodiments with the spring arm 15, so-called abutments 20 are disposed at the inner free end thereof. The abutments are of a configuration which is extended inwardly and rearwardly parallel to the long axis 8 of the carrier 1 and they thus extend into the physical region of the arc plate 4.

The arc plate 4 is of a thickness D which is greater than that of the holder 13 or also the counterpart support 12 on the spring arm 15 of the carrier 1 (FIG. 2). In that way it is possible to mill out at the free ends of the arc plate 4 a respective recess 21 which then forms a sliding bearing for the respective abutment 20. Forces acting in the direction of the central axis 6 in FIGS. 1 and 4 through 8 in a direction of viewing on to the plane of the paper (for example when screwing on a screwthreaded cap) are then held by the surface 22, which has remained, of the recess 21, and the spring arms 15 with their abutments 20 are therefore in practice held and supported against flexural distortion.

FIG. 5 is a broken-away view in cross-section showing a pack 23 in the form of a PET bottle with the main body 24 and the pouring neck 26 provided with a male screwthread 25. The pouring neck 26 represents a round body which can be held and arrested by the device described herein. As the radial projection the round body/pouring neck 26 has a neck ring 27. As shown in FIG. 5 the pouring neck/round body 26 can be pushed in the direction of the arrow 28 into the U-shaped opening 2, in such a way as to reach the end position shown in FIG. 5, in which the arc plate 4 comes to bear between the main body 24 and the neck ring/radial projection 27. In that way the entire pack 23 is held in respect of movements in the direction of the central axis 6 (towards the right or the left in FIG. 5).

That condition of the pack 23, involving being introduced into the arcuate bottom 3 of the carrier 1, can be seen in a plan view in which the direction of viewing is in the direction of the central line 6, in FIG. 4. The ring shown by hatching therein represents the pouring neck/round body 26. In the bottom 3 the pouring neck 26 bears against the edge or arc 3*a* of the arc plate 4, and the pouring neck 26 is supported at each end of the arc plate 4: in FIG. 4 on the left-hand side against the counterpart support 12 by way of the inclined run-out surface 11 and opposite thereto at the right against the projecting edge 10 of the engagement portion 9 which is in the form of a cutting insert. Rotation of the pouring neck 26 in the clockwise direction corresponding to the curved arrow 29 in FIG. 4 is not possible for the sharp edge 10 of the engagement portion 11 digs into the cylindrical outer surface of the pouring neck 26. For release purposes, the pack 23 and therewith the pouring neck 6 are rotated in the counter-clockwise direction, that is to say in the opposite direction to the curved arrow 29, in the plan view in FIGS. 4 and 6, so that, after a short rotary movement, the condition shown in FIG. 6 is reached. The pouring neck 26 has just left the bottom 3. The crescent moon-shaped space can be seen there. The rotary movement is effected over the projecting edge 10 of the engagement portion 9 while the diametrally opposite side of the pouring neck 26 slides outwardly over the inclined run-out surface 10, in which case the spring arm 15 is pushed resiliently away towards the left into its undercut configuration 18. Now, there is sufficient space between the projecting edge 10 and the inclined run-out surface 11 so that the entire pouring neck 26 can be moved out of the U-shaped opening 2 and thus out of the carrier 1.

List of References

1 carrier
2 U-shaped opening
3 arcuate bottom
3*a* arc
4 arc plate
5 weld bead
6 central axis
7 diameter line
8 longitudinal axis of the carrier
9 arresting engagement portion
10 projecting edge (cutting edge)
11 inclined run-out surface
12 counterpart support
13 holder for arresting engagement portion
14 fixing location
15 spring arm
16 spring
17 side limb edge
18 undercut configuration
19 adjusting screw
20 abutment
21 recess
22 surface which has remained
23 pack
24 main body
25 male screwthread
26 pouring neck, round body
27 neck ring, radial projection
28 arrow, insertion direction,
29 arrow, direction of rotation
M central point of the arc 3*a*
Q transverse line

What is claimed is:

1. A device for holding in the longitudinal direction a cylindrically-shaped body (26) having at least one radial projection (27) and for arresting same against a torque applied to the body (26) in one of two rotary directions (29) upon rotation about the longitudinal axis of the body (26), comprising a planar carrier (1) which is open at one side and which partially embraces the body (26) and which has a U-shaped opening (2) with an arcuate bottom (3), said arcuate bottom (3) having abutting said cylindrically-shaped body and—has an extended part-circular arc (3*a*) having a central point (M) with a central axis (6) extending there through perpendicular to the plane of the carrier (1).

a projecting engagement portion (9) for arresting against rotary movements (29), characterised in that the projecting arresting engagement portion (9) is arranged in the radial direction to the central axis (6) of the part-circular arc (3*a*) of the bottom (3), at the level of the arcuate bottom (3) of the carrier (1), and is displaced radially in relation to the part-circular arc (3*a*) of the bottom (3) in the region of the open side of the bottom (3), and a counterpart support (12) is provided on the other side approximately on the part-circular arc (3*a*) in opposition relationship to the engagement portion (9), and that the counterpart support (12) is provided with an inclined run-out surface for supporting the round body (26) and is resiliently biased in a direction approximately towards the central point (M), which is on the central axis (6), of the part-circular arc (3*a*).

2. A device as set forth in claim 1 characterised in that the arresting engagement portion (9) has a projecting edge (10) extending radially and is resiliently biased in a direction approximately towards the central point (M), which is on the central axis (6), of the part-circular arc (3*a*), and characterised in that the arresting engagement portion (9) operates with a motion in the radial direction of the central axis (6) to engage the body (26).

3. A device as set forth claim 1, characterised in that the arresting engagement portion (9) is a culling insert fixed in a holder (13).

4. A device for holding in the longitudinal direction a round cylindrically-shaped body (26) having at least one radial projection (27) and for arresting same against a torque applied to the body (26) in one of two rotary directions (29) upon rotation about the longitudinal axis of the body (26), comprising:

a planar carrier (1) which is open at one side and which partially embraces the body (26) and which has a U-shaped opening (2) with an arcuate bottom (3), said arcuate bottom (3) having an extended arc (3*a*) having a central point (M) with a central axis (6) extending there through perpendicular to the plan of the carrier (1), a projecting engagement portion (9) for arresting against rotary movements (29), characterised in that the projecting arresting engagement portion (9) is arranged in the radial direction of the central axis (6) at the level of the arcuate bottom (3) of the carrier (1) on the extended arc (3*a*) of the bottom (3) displaced radially in relation to the extended arc (3*a*) of the bottom (3) in the region of the open side of the bottom (3), and a counterpart support (12) is provided on the other side approximately on the extended arc (3*a*) in opposition relationship to the engagement portion (9), and that the couterpart support (12) is provided with an inclined run-out surface for supporting the round body (26) and is resiliently biased in a direction approximately towards the central point (M), which is on the central axis (6), of the part-circular arc (3*a*).

further characterised in that the arresting engagement portion (9) has a projecting edge (10) and is resiliently biased in a direction approximately towards the central point (M), which is on the central axis (6), of the part-circular arc (3*a*), that the arresting engagement portion (9) is a cutting insert fixed in a holder (13), and that the counterpart support (12) and/or the holder (13) for the arresting engagement portion (9) has a spring arm (15) which forms the side limb edge (17) of the U-shaped opening (2) of the carrier (1) and is fixed at the open end of the U-shaped opening (2) to the carrier (1) and the carrier (1) has undercut configurations (18) behind the spring arm (15).

5. A device as set forth in claim 4 characterised to have a second spring arm (15) which forms a second side limb edges of the (17) of the U-shaped opening (2) of the carrier (1) and also characterised in that the arcuate bottom (3) of the carrier (1) is formed by an approximately simicircular arc plate (4) which is fixed to the carrier (1) and the thickness (D) of which, in the direction of the central axis (6), is greater than that of the carrier (1), and the free ends of the arc plate (4) have recesses (21) for supporting abutments (20) disposed on the spring arms (15).

6. A device as set forth in claim 5 characterized in that the surfaces of the carrier (1) are in a plane flush with the surfaces of the spring arms (15), the holders (13) with the abutments (20) and the arc plate (4).

7. A device as set forth in claim 5 characterised in that the round body (26) to be arrested is a pouring neck (26), comprising plastic material, or a pack (23), and characterised in that the inside diameter of the arc plate is approximately equal to the outside diameter of the pouring neck (26).

8. A device as set forth in claim 6 characterised in that the round body (26) to be arrested is a pouring neck (26), comprising plastic material, or a pack (23), and characterised in that the inside diameter of the arc plate is approximately equal to the outside diameter of the pouring neck (26).

* * * * *

UNITED STATES PATENT AND TRADEMARK OFFICE

CERTIFICATE OF CORRECTION

PATENT NO. : 6,898,920 B2
DATED : May 31, 2005
INVENTOR(S) : Hans Hoss

It is certified that error appears in the above-identified patent and that said Letters Patent is hereby corrected as shown below:

Column 9,
Line 10, delete “having”;
Line 11, replace “and—has” with -- and having --;

Column 10,
Line 1, insert -- in -- after “forth”;
Line 2, replace “culling” with -- cutting --;
Line 12, replace “plan” with -- plane --;

Column 11,
Line 3, replace “edges of the (17)” with -- edge (17) --.

Signed and Sealed this

Twenty-third Day of August, 2005

JON W. DUDAS
*Director of the United States Patent and Trademark Office*